US009518478B2

(12) United States Patent
Smith et al.

(10) Patent No.: US 9,518,478 B2
(45) Date of Patent: Dec. 13, 2016

(54) MICROCHANNEL EXHAUST FOR COOLING AND/OR PURGING GAS TURBINE SEGMENT GAPS

(71) Applicant: General Electric Company, Schenectady, NY (US)

(72) Inventors: Aaron Ezekiel Smith, Simpsonville, SC (US); David Wayne Weber, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 527 days.

(21) Appl. No.: 14/064,867

(22) Filed: Oct. 28, 2013

(65) Prior Publication Data

US 2015/0118033 A1 Apr. 30, 2015

(51) Int. Cl.

| | |
|---|---|
| ***F01D 25/12*** | (2006.01) |
| ***F01D 11/00*** | (2006.01) |
| ***F01D 9/04*** | (2006.01) |

(52) U.S. Cl.

CPC ..... *F01D 25/12* (2013.01); *F01D 9/04* (2013.01); *F01D 11/003* (2013.01); *F01D 11/005* (2013.01); *F01D 11/008* (2013.01); *F05D 2240/11* (2013.01); *F05D 2240/57* (2013.01)

(58) Field of Classification Search

CPC ..... F01D 11/005; F01D 11/08; F01D 9/04; F01D 25/12; F05D 2240/11; F05D 2240/57

See application file for complete search history.

(56) References Cited

U.S. PATENT DOCUMENTS

| | | | | |
|---|---|---|---|---|
| 4,063,851 | A | 12/1977 | Weldon | |
| 4,288,201 | A | 9/1981 | Wilson | |
| 4,650,394 | A | 3/1987 | Weidner et al. | |
| 4,721,433 | A * | 1/1988 | Piendel | F01D 25/14 415/115 |
| 4,767,260 | A | 8/1988 | Clevenger et al. | |
| 4,798,515 | A | 1/1989 | Hsia et al. | |
| 4,902,198 | A | 2/1990 | North | |
| 5,088,888 | A * | 2/1992 | Bobo | F01D 11/005 277/644 |
| 5,167,485 | A | 12/1992 | Starkweather | |
| 5,488,825 | A | 2/1996 | Davis et al. | |
| 5,531,437 | A | 7/1996 | Coombs | |
| 5,531,457 | A * | 7/1996 | Tibbott | F01D 11/005 277/590 |
| 5,762,471 | A | 6/1998 | Cunha | |
| 6,099,244 | A | 8/2000 | Tomita et al. | |
| 6,241,467 | B1 | 6/2001 | Zelesky et al. | |

(Continued)

OTHER PUBLICATIONS

U.S. Appl. No. 14/048,778, filed Oct. 8, 2013.

*Primary Examiner* — Ninh H Nguyen

(74) *Attorney, Agent, or Firm* — Nixon & Vanderhye P.C.

(57) ABSTRACT

A gas turbine stator component includes a composite, segmented ring made up of an annular array of arcuate segments, each having end faces formed with respective seal slots, with radial gaps formed between opposed end faces of adjacent arcuate segments. A seal is located between each pair of opposed seal slots to thereby seal the gaps, and a channel is provided in each of said arcuate segments adapted to be supplied with cooling air, the channel connecting to a passage extending between the channel and a respective one of the seal slots or radial gaps, on a lower-pressure side of the seal.

20 Claims, 4 Drawing Sheets

(56) References Cited

U.S. PATENT DOCUMENTS

| | | | | |
|---|---|---|---|---|
| 6,254,333 | B1 | 7/2001 | Merry | |
| 6,340,285 | B1 * | 1/2002 | Gonyou | F01D 11/005 415/116 |
| 6,354,795 | B1 * | 3/2002 | White | F01D 11/24 415/116 |
| 6,517,312 | B1 | 2/2003 | Burns et al. | |
| 7,217,081 | B2 * | 5/2007 | Scheurlen | F01D 11/008 277/642 |
| 8,201,834 | B1 * | 6/2012 | Liang | F01D 11/005 277/637 |

* cited by examiner

MICROCHANNEL EXHAUST FOR COOLING AND/OR PURGING GAS TURBINE SEGMENT GAPS

The present invention relates generally to cooling turbine engine components and more specifically, to cooling stator shrouds, or other stator components having a similar geometry, and associated seals within the hot gas path of a gas turbine, downstream of the turbine combustor(s).

BACKGROUND OF THE INVENTION

In general, gas turbines combust a mixture of compressed air and fuel to produce hot combustion gases. The combustion gases may flow through one or more turbine sections to generate power to drive, for example, an electrical generator and/or a compressor. Within the gas turbine sections, the combustion gases typically flow through one or more stages of nozzles and blades (or buckets). The turbine nozzles may include circumferential rings of stationary vanes that direct the combustion gases to the rotating blades or buckets attached to the turbine rotor. As the combustion gases flow past the buckets, the combustion gases drive the buckets to rotate the rotor, which, in turn, drives the generator or other device. The hot combustion gases are contained using seals between circumferentially-adjacent arcuate segments of stationary shrouds surrounding the nozzle vanes and/or buckets; between the platforms of circumferentially-adjacent rotating buckets or bucket segments on a rotor wheel; and seals between axially adjacent nozzle and bucket shrouds of the same or successive turbine stages.

The seals are designed to prevent or minimize ingestion of higher-pressure compressor discharge or extraction flows into the lower-pressure hot gas path. Nevertheless, leakage about the seals is inevitable and results in reduced compressor performance which contributes to an overall reduction in the efficiency of the turbine.

At the same time, the hot gas path components, including the shroud segments and seals must be cooled to withstand the extremely high combustion gas temperatures. Conventional cooling schemes usually involve some combination of internal cooling features and associated cooling technique (for example, impingment, serpentine, pin-fin bank, near-wall cooling) where the cooling air is eventually exhausted through film-cooling holes that enable additional cooling of the surface of the component. In some instances, however, it is not desirable to exhaust all or part of the internal cooling flow in this manner.

While various techniques have been employed to cool the shrouds and seals between adjacent shroud and other similar stator component segments, it remains desirable to provide enhanced cooling for the shrouds and seals, and to use the heated or spent cooling air for at least one other purpose, for example, to purge the segment gap, i.e., diluting the hot combustion gases below (i.e., radially inward of) the seal, thus cooling the seal while also preventing or minimizing compressor extraction flows from leaking into the hot gas path.

BRIEF DESCRIPTION OF THE INVENTION

In one exemplary but non limiting embodiment, there is provided a segment for a ring-shaped rotary machine stator component comprising a segment body having an end face formed with a circumferentially-facing seal slot adapted to receive a seal extending between the segment body and a corresponding seal slot in an adjacent segment body; a channel provided in the segment body in proximity to the seal slot, supplied with cooling air; and a passage extending from the channel into the seal slot.

In another exemplary aspect, there is provided an annular turbine component comprising: plural arcuate segments arranged to form a complete annular ring, each segment having end faces provided with seal slots; a seal extending between seal slots of adjacent segments sealing radially oriented gaps between the segments; a channel provided in each segment in proximity to at least one of said seal slots, and adapted to be supplied with cooling air; and a passage extending from said channel and opening into said at least one seal slot on a radially-outer, high-pressure side of the seal.

In still another aspect, there is provided a gas turbine stator comprising first and second axially adjacent, annular shrouds having opposed end faces provided with respective seal slots; wherein a circumferential, axially-extending gap is formed between the opposed end faces; a circumferential seal seated in the respective seal slots to thereby seal the axially-extending gap, the seal, in use, separating relatively higher and lower pressure areas on radially-outer and radially-inner sides thereof, said radially-inner side exposed to a hot gas path; and one or more cooling channels provided within each of the first and second axially-adjacent, annular shrouds adapted to be supplied with cooling air, the one or more cooling channels arranged to introduce cooling air into a respective one of the seal slots or axially-extending gaps in the relatively lower pressure area on the radially-inner side of the seal.

The invention will now be described in greater detail in connection with the drawings identified below.

DETAILED DESCRIPTION OF THE INVENTION

Figure 1:
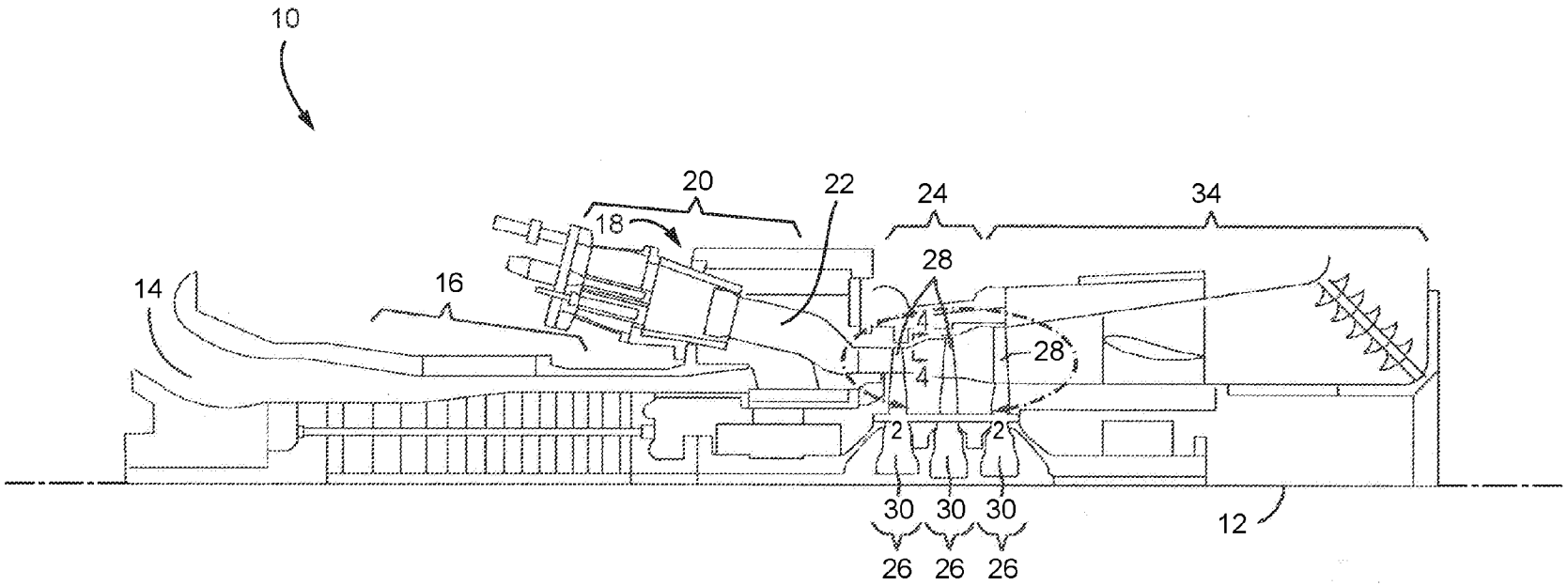
FIG. 1 is a partial sectional view of a gas turbine engine along an axis of rotation of the engine.
Figure 2:
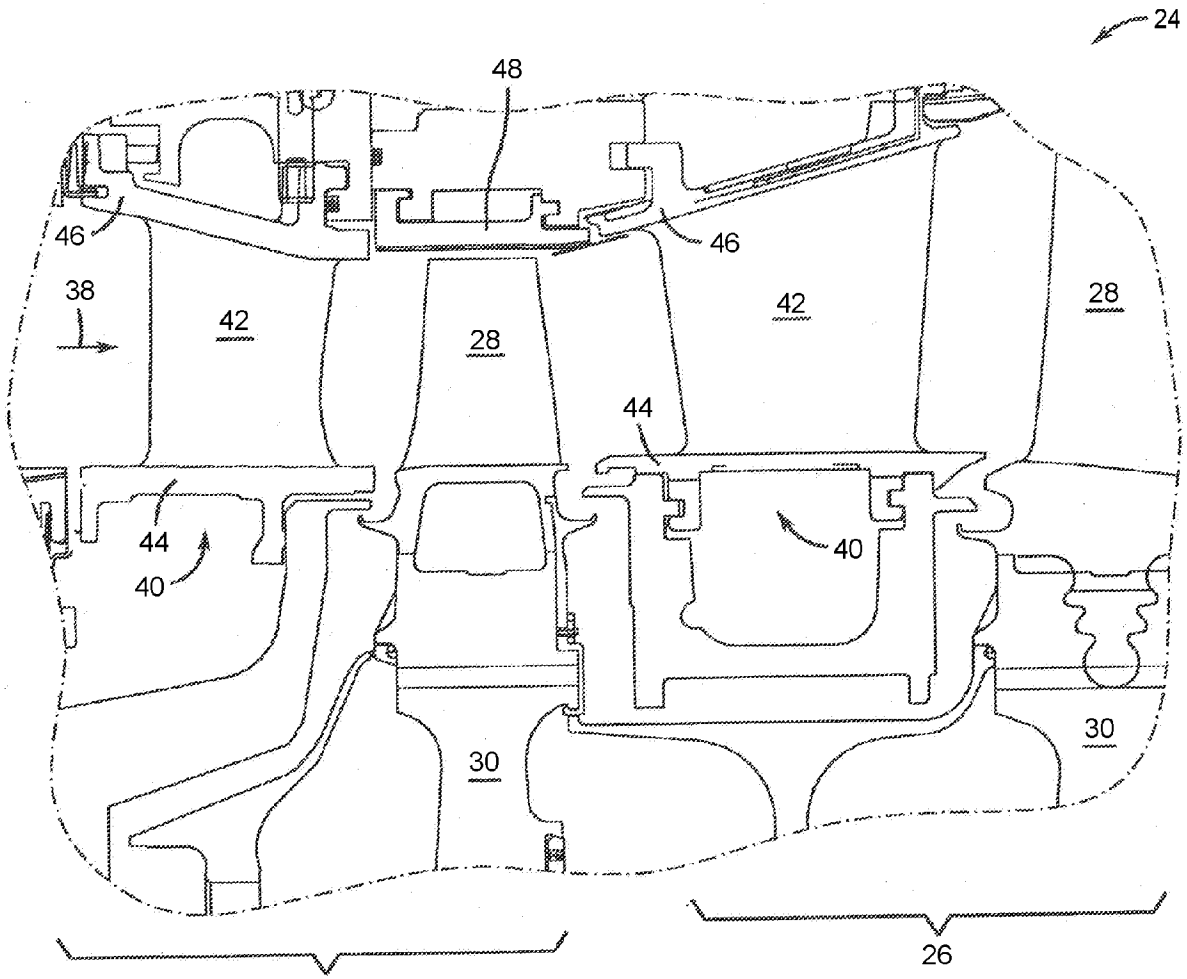
FIG. 2 is an enlarged detail of the encircled area indicated by reference numeral 36 in FIG. 1.

FIG. 1 is a cross-sectional side view of a conventional gas turbine engine 10 taken along a longitudinal axis 12, i.e., the axis of rotation of the turbine rotor. With reference also to the enlarged detail in FIG. 2, it will be appreciated that air enters the gas turbine engine 10 through the air intake section 14 of a compressor 16. The compressed air exiting the compressor 16 is directed to the combustors 18 (one shown) to mix with fuel which combusts to generate hot combustion gases. Multiple combustors 18 may be annularly disposed within the turbine combustor section 20, and each combustor 18 may include a transition piece 22 that directs the hot combustion gases from the combustor 18 to the gas turbine section 24. In other words, each transition piece 22 defines a hot gas path from its respective combustor 18 to the turbine section 24.

The illustrated, exemplary gas turbine section 24 includes three separate stages 26. Each stage 26 includes a set or row of buckets 28 coupled to a respective rotor wheel 30 that is rotatably attached to the turbine rotor or shaft represented by the axis of rotation 12. Between each wheel 30 is a set of nozzles 40 incorporating a circumferential row of stationary vanes or blades 42. The nozzle vanes 42 are supported between segmented, inner and outer stator shrouds or side walls 44, 46, each segment incorporating one or more vanes, while the buckets 28 are surrounded by stationary, stator shroud segments 48. The nozzle and bucket shrouds serve to contain the hot combustion gases and allow a motive force to be efficiently applied to the buckets 28. The hot combustion gases exit the gas turbine section 24 through the exhaust section 34.

Applications for the present invention relate to seals extending across radially-oriented gaps between circumferentially-adjacent nozzle vane and/or bucket shroud segments; between circumferentially-adjacent buckets; and between axially-adjacent shrouds (nozzle and bucket) in the same or adjacent stage.

It will be understood, of course, that although the turbine section 24 is illustrated as a three-stage turbine, the cooling and sealing arrangements described herein may be employed in turbines with any number of stages and shafts, e.g., a single stage turbine, a dual turbine that includes a low-pressure turbine section and a high-pressure turbine section, or in a multi-stage turbine section with three or more stages. Furthermore, the cooling and sealing arrangements described herein may be utilized in gas turbines, steam turbines, hydroturbines, etc.

Typically, discharge air from the compressor 16 (also known as compressor extraction flow) (FIG. 1), which may act as a cooling fluid, may be directed through the stationary vanes 42, the inner and outer band segments 44 and 46, and/or the shroud segments 48 to provide the required cooling of these components.

In the exemplary but nonlimiting embodiment described herein, the discharge air from the compressor 16 is also used as a cooling fluid to mitigate or control the buildup of thermal energy on the hot side of the shroud segments 48 facing the buckets 28.

In some embodiments, other cooling fluids may be used in addition to or in lieu of the compressor discharge air, such as steam, recirculated exhaust gas, or fuel.

Figure 4:
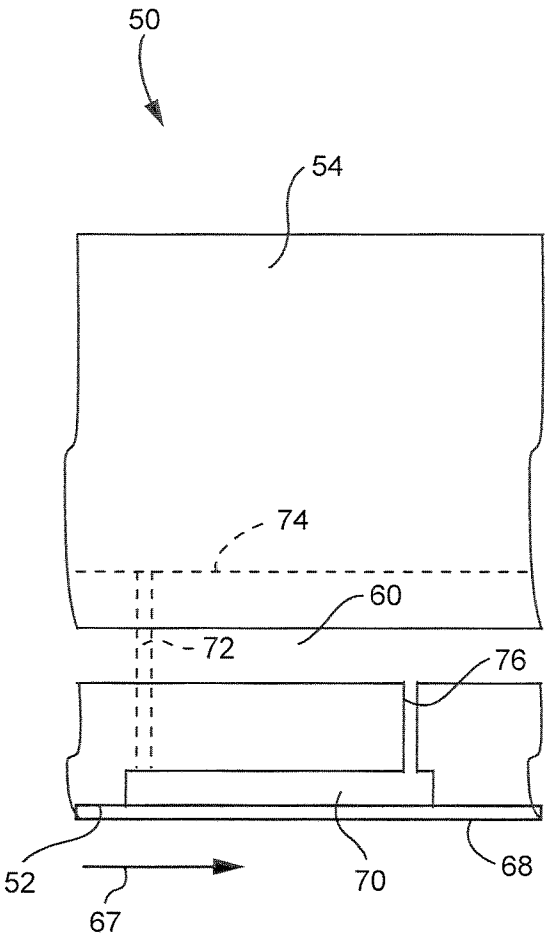
FIG. 4 is a partial side circumferential view of a gas turbine shroud segment in accordance with the embodiment of FIG. 3.
Figure 3:
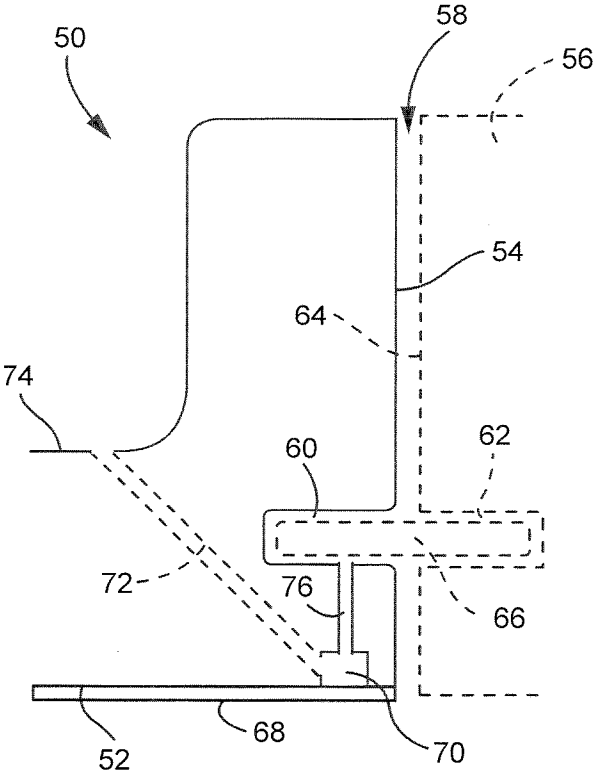
FIG. 3 is a partial front view of a gas turbine shroud segment in accordance with an exemplary but nonlimiting embodiment.

FIGS. 3 and 4 are partial end views of a stator shroud segment 50 (i.e., one arcuate segment of the annular shroud 48) in accordance with a first exemplary but nonlimiting embodiment. It will be understood that the shroud segment 50 as viewed in FIG. 3 includes a radially-inner surface 52 that faces or lies radially adjacent a row of buckets 28 on a turbine wheel as described in connection with FIG. 2. A circumferential interface surface 54 (or end face) lies opposite an adjacent shroud segment 56 (shown in phantom), with a radially-extending gap 58 therebetween. A seal slot 60 formed in the interface surface or end face 54 is aligned with a similar slot 62 in the adjacent interface surface 64, the pair of slots adapted to receive a seal 66 that inhibits radially-inward leakage of higher-pressure compressor extraction flows into the hot combustion gases flowing along the hot gas path 67 (FIG. 4). It will be understood that a similar seal/seal slot arrangement is provided on the opposite interface surface such that the seals extend between adjacent slots of adjacent segments about the entire annular shroud.

In the illustrated embodiment, surface 52 (or hot-gas-facing side) may be coated with a known thermal barrier coating (TBC) 68 to provide some protection for the surface 54 which is directly exposed to the hot combustion gases.

A channel 70 is formed in the surface 52, extending in an axial direction (parallel to the hot gas path) in the exemplary embodiment. The channel 70 could also extend in a circumferential direction and could also have a wavy, zig-zag or other suitable shape. The channel 70, which may be of any desired length, is supplied with cooling air, e.g., compressor extraction air, by means of a passage 72 extending angularly from a radially-outer surface 74 of the shroud segment 50 and opening into the channel 70 at one end thereof. Thus, the passage 72 maybe regarded as an inlet passage. In an exemplary embodiment shown in FIG. 3, an outlet passage 76 is formed in the shroud segment, extending radially outward from an opposite end of the channel 70, and into the seal slot 60. In this way, cooling air passing through the channel 70 absorbs heat, and thus cools the surface 52 (and TBC 68), and the heated cooling air is then exhausted to the seal slot 60 where it cools the underside or low-pressure side of the seal, and then enters and purges the part of the gap 58 which lies radially inward of the seal 66, i.e., the spent cooling air mixes with and dilutes the hot gas in the segment gap that would otherwise make the seal and segment end faces too hot. The flow of air into that part of the gap radial inward of the seal 66 also inhibits leakage of higher-pressure compressor air into the hot gas path. It will be understood that different seal configurations will dictate the exact flow of the heated cooling air upon reaching the seal slot 60. It will also be understood that a similar cooling arrangement is provided in the adjacent shroud segment 56.

Figure 6:
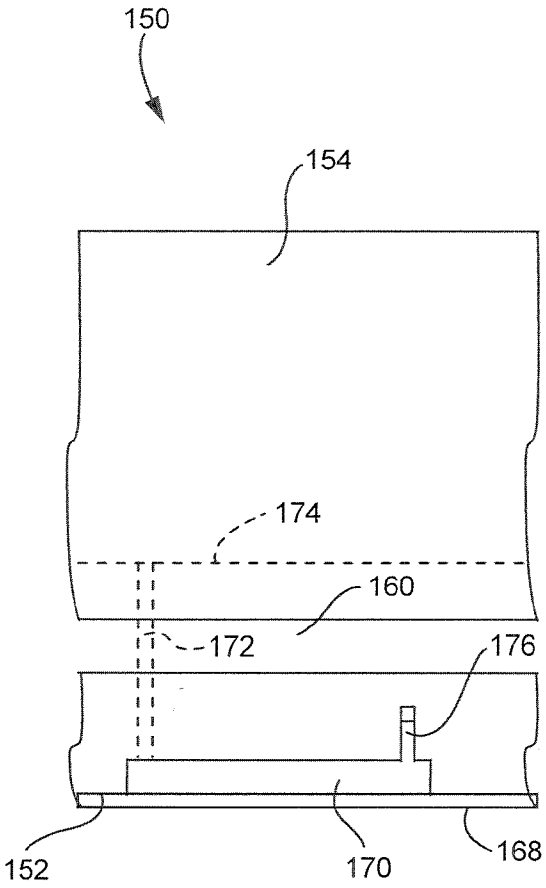
FIG. 6 is a partial side view of a gas turbine shroud segment in accordance with the embodiment of FIG. 5.
Figure 5:
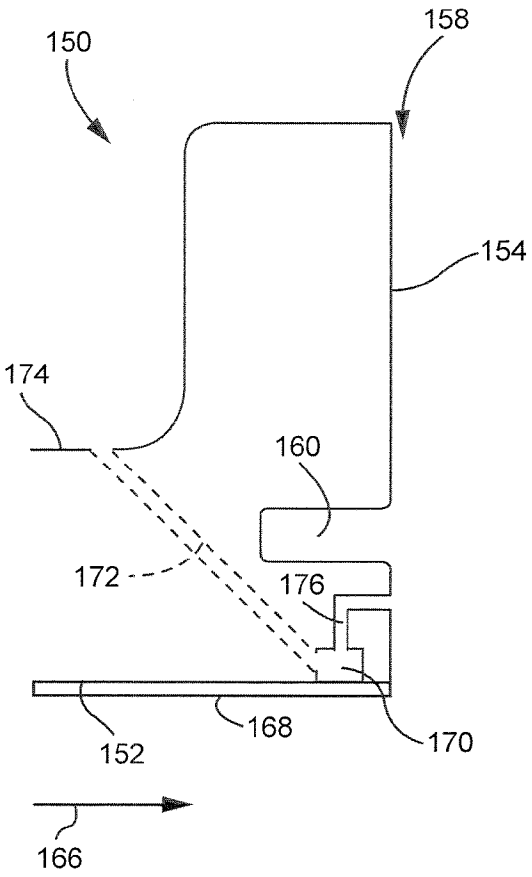
FIG. 5 is a partial front view of a gas turbine shroud segment in accordance with another exemplary but nonlimiting embodiment.

In another exemplary shown in FIGS. 5 and 6, the shroud segment 150 includes a radially inner surface 152, a circumferential interface surface 154 that faces an adjacent shroud segment (similar to shroud segment 56) with a radially-extending gap 158 therebetween. Seal slot 160 is similar to seal slot 60 and cooperates with an adjacent seal slot (similar to slot 62). The radially-inner surface 152 may also be coated with a TBC 168. As in the previously-described embodiment, an inlet passage 172 extends from a radially-outer surface 174 of the shroud segment and opens into a channel 170. In this embodiment, however, the outlet passage 176 from the channel 170 opens on the end face or surface 154 radially inwardly of the seal slot 160, so as to purge that portion of the gap 158 radially inward of the seal. By having the outlet from passage 176 sufficiently distanced (in the radially outward direction) from the hot gas path, the purge air will be more effective in diluting hot gas in the gap. If the outlet from passage 176 is too close to the hot gas path, the purge air would be immediately sucked into the hot gas path, and additional flow would be required to purge the gap.

In both embodiments, the air otherwise needed to purge the gaps between shroud segments is reduced by the configurations disclosed herein where spent cooling air is exhausted into the gaps radially inward of the seals.

It will also be understood that the TBC coating 68 or 168 may be applied over a plate or other substrate covering the radially-inward side of the channel 70, 170, or the coating itself may close the open side of the microchannel.

With respect to channels 70, 170, various dimensional relationships and geometries are possible. For example, in accordance with certain embodiments, the channels 70 and 170 may be provided as microchannels having widths and depths between approximately 50 microns and 4 mm in any suitable combination. While illustrated as square or rectangular in cross-section, the microchannels may be any suitable shape that may be formed using grooving, etching, or similar forming techniques. For example, the microchannels may have circular, semi-circular, curved, triangular or rhomboidal cross-sections in addition to or in lieu of the square or rectangular cross-sections illustrated. In addition, width and depth of the channel(s) may also vary uniformly or differentially throughout its length. Therefore, the disclosed microchannels may have straight or curved geometries consistent with such cross-sections.

It will be understood that the cooling/sealing arrangement as described above in connection with the bucket shroud 48 is applicable as well to the segments of the inner and outer nozzle shrouds 44, 46. In addition, the cooling/sealing arrangemnts are also applicable to seals located axially between the nozzle shrouds and the bucket shrouds, for example, between nozzle shroud 46 and bucket shroud 48. In the case of axially-adjacent shrouds, seal 66 (configured as a circumferential seal) could be considered as sealing an axial gap 58 between a nozzle shroud 50 and an axially-adjacent bucket shroud 56, recognizing that the opposed edge faces 54, 64 may not be as shown in FIG. 3.

It will also be appreciated that the invention is applicable to any turbine stage although it is believed that stages 1 and 2 would likely benefit from the described arrangements.

While various embodiments are described herein, it will be appreciated from the specification that various combinations of elements, variations or improvements therein may be made by those skilled in the art, and are within the scope of the invention.

What is claimed is:

1. A segment for a ring-shaped, rotary machine stator component comprising:

a segment body having an end face formed with a circumferentially-facing seal slot adapted to receive a seal extending between said segment body and a corresponding seal slot in an adjacent segment body;

a channel provided in said segment body in proximity to said seal slot, supplied with cooling air, wherein said channel includes a radially inward wall and a radially outward wall, said radially inward wall and said radially outward wall are both radially outward of a radially inner surface of said segment that is exposed to a hot air path, and are both radially inward of said seal slot; and a passage extending from said channel into said seal slot.

2. The segment of claim 1 wherein said channel communicates with a cooling air inlet duct adapted to supply cooling air from a cooling air source.

3. The segment of claim 1 wherein said passage opens on a radially inner surface of said seal slot.

4. The segment of claim 1 wherein said channel comprises a microchannel having width and/or depth dimensions of between about 50 microns and about 4 mm.

5. The segment of claim 4 wherein said microchannel has a cross-sectional shape selected from round, semi-circular, square, rectangular, triangular or rhomboidal.

6. The segment of claim 5 wherein said passage opens on a radially inner surface of said seal slot.

7. The segment of claim 4 wherein a hot-gas-facing side of said microchannel is closed by a coating.

8. The segment of claim 7 wherein said coating comprises a thermal barrier coating.

9. The segment of claim 1 wherein said segment body has an arcuate shape.

10. An annular turbine component comprising:

plural arcuate segments arranged to form a complete annular ring, each segment having end faces provided with seal slots;

a seal extending between seal slots of adjacent segments sealing radially oriented gaps between the segments;

a channel provided in each segment in proximity to at least one of said seal slots, and adapted to be supplied with cooling air, wherein said channel includes a radially inward wall and a radially outward wall, said radially inward wall and said radially outward wall are both radially outward of a radially inner surface of said arcuate segments that is exposed to a hot air path, and are both radially inward of said seal slot; and a passage extending from said channel and opening into said at least one of the seal slots or a respective, radially-oriented gap on a radially-inner, low-pressure side of the seal.

11. The annular turbine component of claim 10 wherein said plural arcuate segments combine to form an annular turbine stator nozzle shroud.

12. The annular turbine component of claim 10 wherein said plural arcuate segments combine to form an annular turbine stator bucket shroud.

13. The annular turbine component of claim 10 wherein said channel comprises a microchannel having width and/or depth dimensions of between about 50 microns and about 4 mm.

14. The annular turbine component of claim 13 wherein said microchannel has a cross-sectional shape selected from round, semi-circular, square, rectangular, triangular or rhomboidal.

15. The annular turbine component of claim 13 wherein a radially-inner side of said microchannel is closed by a coating.

16. The annular turbine component of claim 15 wherein a hot-gas-facing side of said channel is closed by a coating.

17. The annular turbine component of claim 10 wherein said passage opens on one of said end faces at a location closer to the seal than to the hot gas path.

18. A gas turbine stator comprising:

first and second axially adjacent, annular shrouds having opposed end faces provided with respective seal slots; wherein a circumferential, axially-extending gap is formed between said opposed end faces;

a circumferential seal seated in said respective seal slots to thereby seal said axially-extending gap, said circumferential seal, in use, separates relatively higher and lower pressure areas on radially-outer and radially-inner sides of said circumferential seal, said radially-inner side is exposed to a hot gas path;

a passage having an outlet open to at least one of the respective seal slots or to the circumferential seal, and one or more cooling channels provided within each of said first and second axially-adjacent, annular shrouds adapted to be supplied with cooling air and to feed the cooling air to the passage, said one or more cooling channels arranged to introduce cooling air, via the passage, into a respective one of said seal slots or axially-extending gaps in the relatively lower pressure area on said radially-inner side of said seal, wherein said one or more cooling channels includes a radially inward wall and a radially outward wall, said radially inward wall and said radially outward wall are both provided in between said seal slots and a radially inner surface of said annular shrouds in the radial direction.

19. The gas turbine stator of claim 18 wherein said first annular shroud comprises a stator nozzle shroud.

20. The gas turbine stator of claim 18 wherein said second annular shroud comprises a stator bucket shroud.

* * * * *